US012110884B2

(12) United States Patent
Nguon et al.

(10) Patent No.: US 12,110,884 B2
(45) Date of Patent: Oct. 8, 2024

(54) INSTALLATION FOR CONTROLLING A HYDRAULIC INSTALLATION WITH A PLURALITY OF RECEIVERS OPERATING IN PARALLEL

(71) Applicant: Robert Bosch GmbH, Stuttgart (DE)

(72) Inventors: Denis Nguon, Lyons (FR); Gilles Florean, Lyons (FR)

(73) Assignee: Robert Bosch GmbH, Stuttgart (DE)

( * ) Notice: Subject to any disclaimer, the term of this patent is extended or adjusted under 35 U.S.C. 154(b) by 366 days.

(21) Appl. No.: 17/143,830

(22) Filed: Jan. 7, 2021

(65) Prior Publication Data

US 2021/0215175 A1 Jul. 15, 2021

(30) Foreign Application Priority Data

Jan. 9, 2020 (FR) ..... 2000167

(51) Int. Cl.
*F04B 49/06* (2006.01)

(52) U.S. Cl.
CPC ..... *F04B 49/065* (2013.01)

(58) Field of Classification Search
CPC ..... F04B 49/065
See application file for complete search history.

(56) References Cited

U.S. PATENT DOCUMENTS 5,535,587 A * 7/1996 Tanaka ..... F15B 21/087 60/427
6,173,573 B1 * 1/2001 Kamada ..... F15B 21/087 60/422

OTHER PUBLICATIONS

Rexroth Bosch Group, Axial Piston Variable Pump A10VO Series 52 and 53, Dec. 2015 (68 pages).

* cited by examiner

*Primary Examiner* — Kenneth Bomberg
*Assistant Examiner* — Michael Quandt
(74) *Attorney, Agent, or Firm* — Maginot, Moore & Beck LLP

(57) ABSTRACT

A control system for controlling a hydraulic installation with a plurality of receivers operating in parallel includes control units which regulate control positions of each of the receivers supplied by a pump, the pressure and flow rate of which are regulated by a regulator with or without flow rate sharing. The distributor associated with each receiver is switched between modes by a switch associated with each receiver. A counter supplies a control signal to the switches in order to switch them to flow rate sharing mode, if at least two receivers must be activated. Each control unit generates a pressure value and a flow rate value in order, in flow rate sharing mode, to generate a flow rate regulation signal corresponding to the sum of all the flow rates, and a pressure signal corresponding to the highest pressure out of all the pressures.

7 Claims, 3 Drawing Sheets

INSTALLATION FOR CONTROLLING A HYDRAULIC INSTALLATION WITH A PLURALITY OF RECEIVERS OPERATING IN PARALLEL

This application claims priority under 35 U.S.C. § 119 to application no. 2000167, filed on Jan. 9, 2020 in France, the disclosure of which is incorporated herein by reference in its entirety.

The present disclosure relates to an installation for controlling a hydraulic installation with a plurality of receivers operating in parallel, comprising:

- receivers which are supplied by a pump, the pressure and flow rate of which are regulated by a flow rate sharing regulator; and
- a distributor which is associated with each receiver, in order to supply the receiver in a controlled manner downstream from the pump, according to the control position of the control unit.

BACKGROUND

Hydraulic installations are known which equip for example construction machinery such as excavators with a plurality of hydraulic functions, which installations are supplied by a pump, and permit simultaneous operation of a plurality of pieces of equipment. They are composed of a main hydraulic circuit with a controlled pump, which is driven by a motor, and supplies the shunt circuits connected to each actuator (receiver) by means of a distributor with a slider actuated by control signals, on the basis of the movement or position of the control lever.

The displacement or position of the control unit by the operator is detected and used thus to generate an electrical or hydraulic control signal in order to actuate the slider of the distributor associated with this equipment or this function.

At the output from the pump, and downstream from the distributor, two pressure sensors supply two pressure signals to a compensator which controls the operation of the pump, and thus takes into account the implementation of the different receivers.

Schematically, each control lever sends a control pressure signal corresponding to its angle of actuation. This control pressure acts directly on the slider of the distributor associated with the actuator. The pump is controlled by a flow rate regulator.

If the flow rate is sufficient at a given pressure, the flow rate is distributed between the actuators, which can then operate at the required speed.

However, if the flow rate is insufficient, the distribution does not take place, and there is loss of control of the operating speed of the actuators, since the flow will go by precedence to the least loaded actuator.

This disadvantage is avoided by means of compensators which are incorporated in the supply line of each actuator. These compensators which detect the pressure in the supply line of each actuator are connected directly to a selector which sends the highest pressure signal to the regulator of the pump. The pressure difference which is generated by the pump subsides, and the compensators step in, more or less shutting down the supply to the actuators.

The speed drops, but the speed ratio between the different actuators is maintained.

To conclude, this installation requires complex hydraulic devices, in particular hydro-mechanical compensators in order to balance and harmonize the sharing of the flow rate of the pump which supplies the actuators and their equipment.

SUMMARY

The objective of the present disclosure is to provide an installation for controlling a hydraulic installation comprising a plurality of receivers which can operate in parallel, and have different and variable operating characteristics, in order to simplify the control means thereof, and make them more reliable and more accurate.

For this purpose, the subject of the disclosure is a system for controlling a hydraulic installation with a plurality of receivers ($R_i$) operating in parallel, comprising:

- control units J; in order to regulate a control position ($\alpha_j$) of each of the receivers $R_i$ supplied by a pump (1), the pressure (P) and flow rate (Q) of which are regulated by regulator (6), with or without flow rate sharing,
- a distributor ($D_i$) associated with each receiver ($R_i$) in order to supply to the receiver, according to the control position ($\alpha_j$) of the control unit ($J_i$), which control system is characterized in that:
- it comprises an operating mode switch ($PT_i$) which is associated with each receiver $R_i$ and switches the distributor ($D_i$) in order to supply to the distributor with or without flow rate sharing; and a flow rate value counter (26) which supplies an operating mode control signal (SX) to the switches $PT_i$ (i=1 . . . n), in order to switch them to flow rate sharing mode, if at least two receivers ($R_i$) must be activated, or to a mode without flow rate sharing, if a single receiver ($R_i$) is activated;

each control unit ($J_i$) activated at an instant (t) generates a pressure value ($P_i$ ($\alpha_j$)) and a flow rate value ($Q_i$ ($\alpha_j$)) according to its control position ($\alpha_j$), in order, in flow rate sharing mode to:

- generate a flow rate regulation signal (SQC) corresponding to the sum of all the flow rates ($Q_i$ ($\alpha_j$)), and a pressure signal ($SP_{max}$) corresponding to the highest pressure ($P_{max}$) out of all the pressures ($P_i$ ($\alpha_j$)), in order to control the pump (1); and
- regulate each distributor ($D_i$) at the instant (t) depending on the flow rate required ($Q_i$ ($\alpha_j$)) at that instant according to the control position ($\alpha_j$).

This control system thus incorporates all the activated branches of the hydraulic installation. Even the branches which are not activated are integrated automatically, since they supply pressure and flow rate demand signals which are zero, and do not intervene either in the total of the flow rates, or in the selection of the maximal pressure.

The distribution of the flow rate of the pump takes place without jarring in the operation of the different pieces of equipment, whilst permitting the equipment which is the most loaded to operate in good conditions even if its speed is lower than its normal operating speed.

According to a particularly advantageous characteristic, the regulation of each distributor also depends on the pressure required at this instant by the control unit associated with this distributor.

According to an advantageous characteristic, the control unit is combined with a conversion unit containing a table of the pressure and flow rate values associated with each control position of the control unit of the receiver, these values being the pressures and flow rates measured for the receiver taken in isolation for the control positions.

According to another advantageous characteristic in flow rate sharing mode, the flow rate required for the regulation position is combined with a corrector coefficient which depends on the pressure required in order to form the control signal of the distributor regulating the supply of the receiver.

According to another advantageous characteristic, the distributors are electrohydraulic distributors controlled by a basic intensity which depends on the flow rate required by the distributor considered alone without flow rate sharing, with the control intensity of the distributor alone controlling the cross-section of passage between the total closure and opening according to the control position, and, in flow rate sharing mode, the control signal is the intensity multiplied by the corrector coefficient.

According to another advantageous characteristic, the pump is controlled by the pressure signal, which is the maximal pressure of the pressures required by the control units and by the cumulative flow rate signal which is the total of the flow rates required.

Thus, all the branches are involved in this control system, since, as already indicated, those which are not operating demand a zero flow rate which does not intervene in the total of the flow rates.

According to another advantageous characteristic, the corrector coefficient $CR_i$ of each receiver $R_i$ depends on the common parameters of the hydraulic circuit at the instant (t) ($P_{max}$, N, No) and on the pressure required $P_i$ ($\alpha_j$) according to the formula:

$$CR_i = \sqrt{\frac{N}{P_{max} \cdot No}} \cdot \sqrt{Poi} \tag{2}$$

In this formula:

$Po_i$=pressure in the receiver $R_i$ at the minimum speed No;

No=minimum speed of rotation of the motor;

$P_{max}$=maximum pressure of all of the operating pressures required by the equipment $E_i$ ($R_i$) activated at an instant (t);

N=speed of rotation of the motor of the pump at the instant (t).

Finally, in general, the subject of the disclosure is a system for controlling a hydraulic installation with a plurality of receivers operating in parallel with distribution of the flow rate of the pump, comprising:

- a pump which is driven by a motor rotating at a speed at the instant, and regulated by a regulator receiving a pressure signal and a flow rate signal;
- branches, each comprising their own means connecting a control unit to the hydraulic receiver of the equipment controlled by the unit;
- a conversion unit connected to the control unit, in order to receive the control position thereof, and generate the flow rate required and the pressure required;
- a mode selector associated with each receiver, and switching the distributor for supply with or without flow rate sharing; and
- a counter of flow rate values supplying an operating mode control signal to the selectors ($PT_i$) (i=1 . . . n) in order to switch them to flow rate sharing mode if at least two receivers must be activated, or to the mode without flow rate sharing if a single receiver is activated;
- a processing module in order to form the corrector coefficient of the flow rate required, and then the control signal of the distributor in flow rate sharing mode;
- an adder receiving the flow rates required in order to add them and form the flow rate control signal which is the total of the flow rates;
- a maximum pressure selector receiving the pressures required and maintaining the maximal pressure required;
- a sensor for the speed of the motor;
- a table containing the pressures and the minimum speed of rotation of the receivers taken separately for the motor of the pump rotating at the minimal speed;
- the cumulative flow rate signal and the maximum pressure signal being applied to the regulator of the pump;
- the "and" signals being applied to each processing module;
- the "and" signals being applied to the processing module;
- the processing module ($MT_i$) forms the correction signal $CR_i$ according to the formula:

$$CR_i = \sqrt{\frac{N}{P_{max} \cdot No}} \cdot \sqrt{Poi} \tag{2}$$

wherein:

$Po_i$=pressure in the receiver $R_i$ at the minimum speed No;

No=minimum speed of rotation of the motor;

$P_{max}$=maximum pressure of all of the operating pressures required by the equipment $E_i$ ($R_i$) activated at an instant (t);

N=speed of rotation of the motor of the pump at the instant (t).

According to an advantageous characteristic, in flow rate sharing mode, the final control signal ($SCF_i$ ($\alpha_j$)) of the distributor ($D_i$) is the intensity ($I_i$ ($\alpha_j$)) of control of the distributor ($D_i$) considered alone without flow rate sharing according to the control position ($\alpha_j$) of the control unit ($J_i$) multiplied by the corrector coefficient ($CR_i$ ($\alpha_j$)) $SCD_i = CR_i \cdot I_i \cdot (\alpha_j)$

BRIEF DESCRIPTION OF THE DRAWINGS

The present disclosure will be described hereinafter in greater detail by means of an embodiment of a control installation represented in the appended drawings in which.

DETAILED DESCRIPTION

Figure 1:
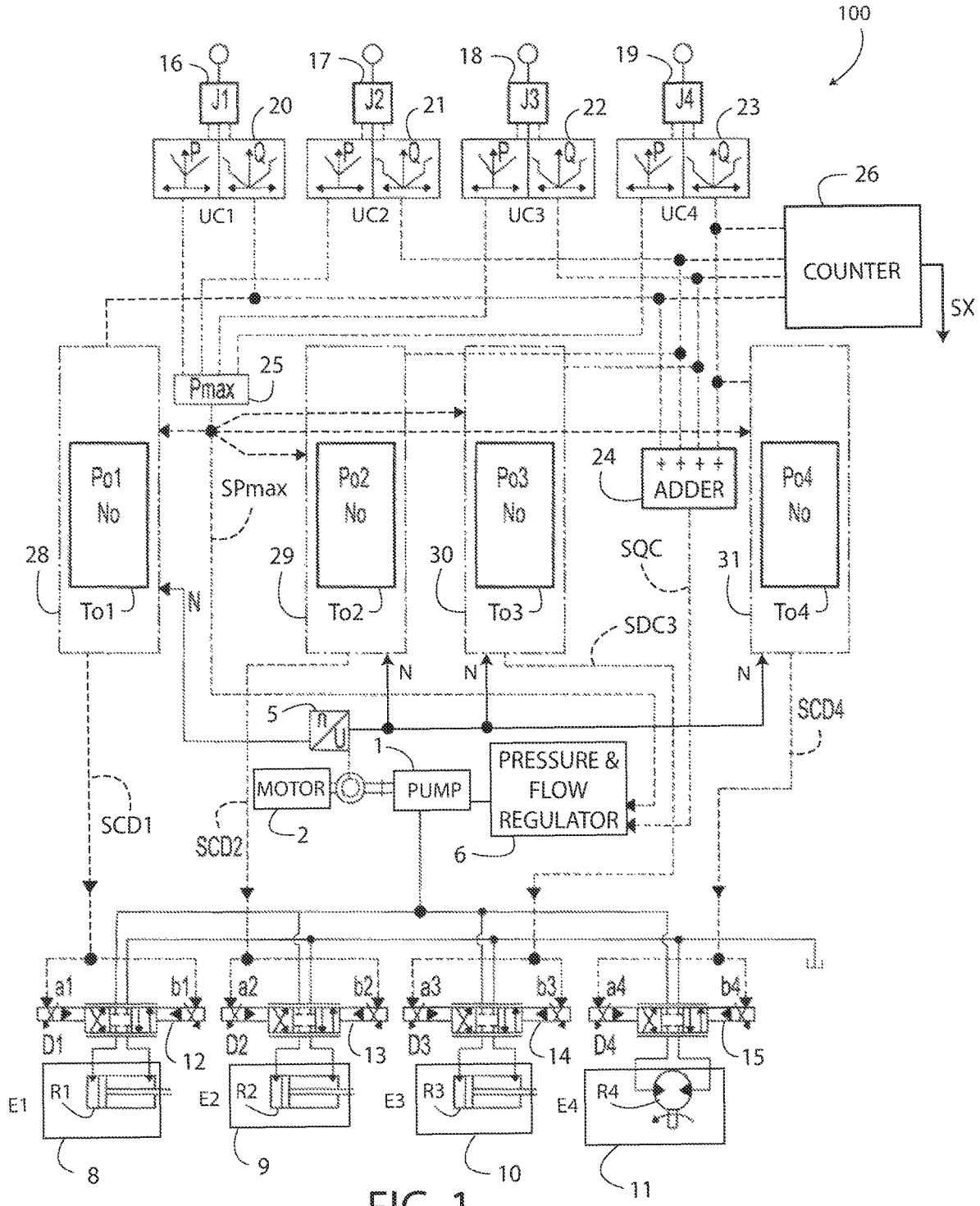
FIG. 1 is a simplified general diagram of a control installation combined with a hydraulic installation with a plurality of receivers which can operate in parallel, four branches of the control installation are illustrated.

FIG. 1 shows an embodiment of a hydraulic installation 100 for controlling hydraulic actuators (receivers) $R_i$ (i=1 . . . 4) associated with mechanical equipment $E_i$ 8, 9, 10, 11, with jacks and/or hydraulic motors supplied by a pump 1 controlled by a pressure and flow regulator 6 which fixes the pressure and flow rate operating points of the pump 1 for the hydraulic circuit thus formed by the different pieces of equipment.

The control installation 100 is composed of (4) parallel branches $BR_i$ (i=1 . . . 4), each being associated with a receiver $R_i$. The branches $BR_i$ are supplied in parallel by the pump 1 with flow rate sharing between the branches which are active at each instant (t), and without flow rate sharing if a single branch $BR_i$ is activated.

Figure 2:
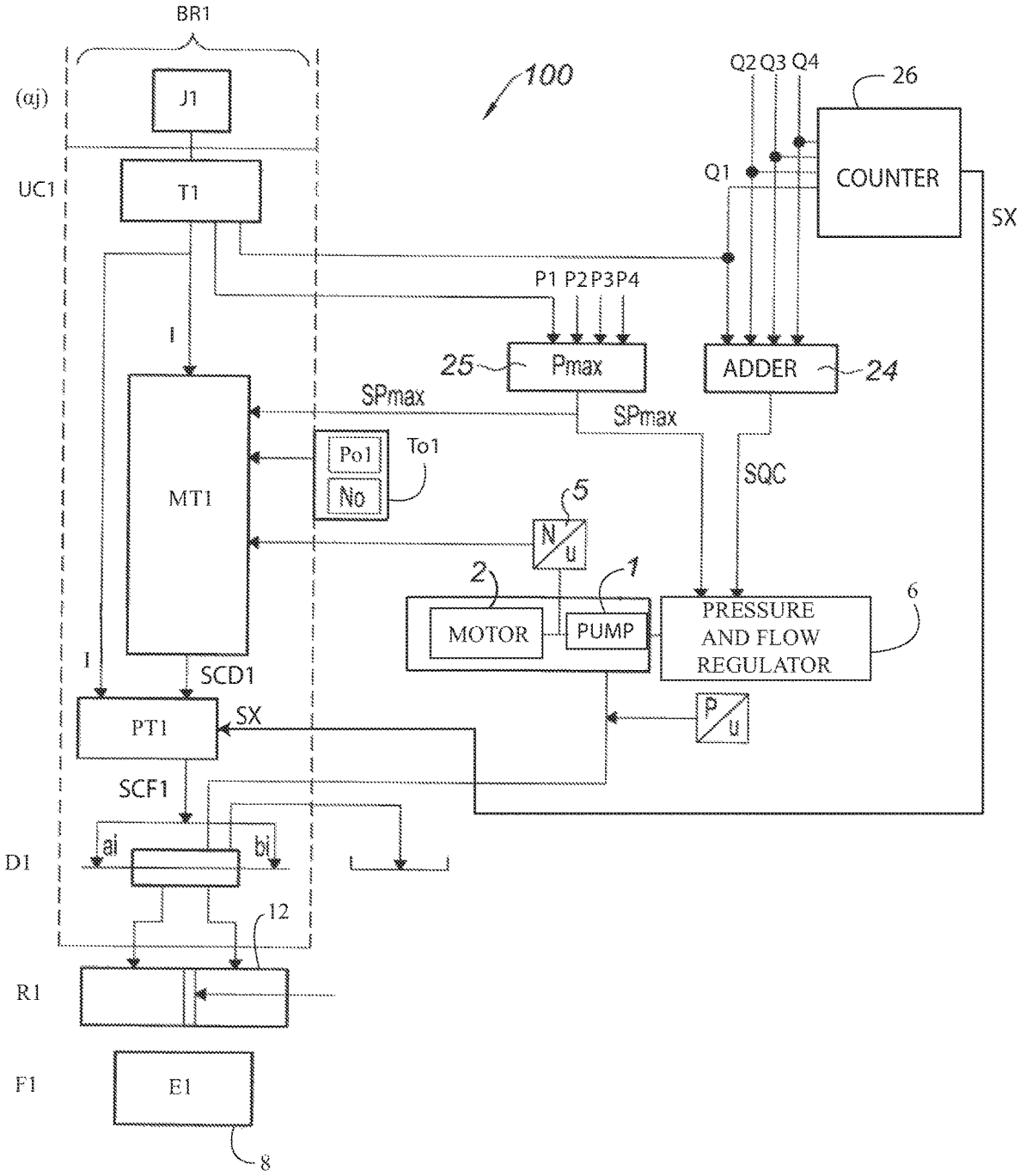
FIG. 2 is a diagram illustrating additional structure of a first branch of the four branches of FIG. 1 and showing how the first branch is connected to the shared components of the control installation.

FIG. 1 is an overall diagram of an installation with four branches $BR_i$ (i=1 . . . 4), and FIG. 2 shows an extract of the installation 100, limited to the representation of a single branch BR (i.e., BR1, the first branch) which is representative in order to explain more easily the operation of the hydraulic circuit with flow rate sharing in the general case of an installation with n branches $BR_i$ (i=1 . . . n). As such, in FIG. 1 the switches PTi of each branch BRi are not shown, but a representative switch PT1 for the representative branch BR1 is shown in FIG. 2. Each branch BRi includes a corresponding switch PTi. The detail of the control of the operating mode with or without flow rate sharing is shown in detail by means of FIG. 3 for one of the branches BRi.

In the case of an excavator, the pieces of equipment $E_i$ are for example a jack 8 which actuates the boom, a jack 9 which actuates the arm supported by the boom, and a jack 10 which actuates the bucket at the end of the arm, as well as a hydraulic motor 11 to control the movement of the turret of the machinery.

The control of the functions $F_i$ (FIG. 2) of these pieces of equipment $E_i$ takes place by means of associated control units Ji (FIG. 1). One piece of equipment $E_i$ can have a plurality of functions $F_i$, for example the equipment for lifting the arm of the excavator can not only ensure the lifting of the arm with its loaded bucket, but also use the bucket as a flattening unit, and be maneuvered repeatedly up and down by means of the same control unit Ji, which is simply switched to this new function $F_i$ in order to have operating characteristics (speed instead of lifting force) for this other function.

Since the arm of the excavator can receive different pieces of equipment Ei, its functions differ, and need pressures P and flow rates Q which are suitable for each function of a single piece of equipment $E_i$.

According to the embodiment of the disclosure, the distributors $D_i$ which supply the receivers $R_i$ and the pump 1 are controlled by means of control units $J_i$ by electrical signals replacing the intermediate hydraulic and mechanical devices or units of the habitual installations.

The control units $J_i$ which are maneuvered by the operator are control levers and optionally pedals or a slider in order to allow a plurality of control units to execute simultaneously a plurality of functions, and according to variable conditions (pressure and flow rate). The position $(\alpha_j)$ in which the operator puts the control unit $J_i$ generates a control signal corresponding to a pressure $P_i$ $(\alpha_j)$ and to a flow rate $Q_i$ $(\alpha_j)$, as well as a signal for control of the distributor $D_i$, in general an intensity signal $I_i$ $(\alpha_j)$ which is dependent on the distributor $D_i$ and on the position $(\alpha_j)$ of the control unit Ji, according to a table $T_i$ (FIG. 2) which will be explained hereinafter.

The control unit $J_i$ can be displaced from a neutral position, or carry out a movement on both sides of a neutral position. The two movement ranges are not necessarily symmetrical; in general they correspond to movements in opposite directions, for example the movement of rising and the movement of descent of the boom of an excavator, which do not have the same characteristics of speed (flow rate) and pressure (load).

The control lever, which is an example of a pivoting control unit $J_i$, comprises a control sensor for position $(\alpha_j)$, which in this case is the angle of pivoting $(\alpha_j)$ with which there are associated the pressure $P_i$ $(\alpha_j)$ and the flow rate $Q_i$ $(\alpha_j)$, which are the values required by the receiver $R_i$, and the intensity $I_i$ $(\alpha_j)$ in order to control the distributor $D_i$ and regulate the flow rate $Q_i$ $(\alpha_j)$ supplying the distributor $D_i$. The relationships between the values $(\alpha_j, P_i, Q_i, I_i)$ are given in the correspondence table $T_i$ (FIG. 2).

The minimal speed No and the pressure $PO_i$ are values which are recorded in a basic table $To_i$ associated with the branch $BR_i$; this table Toi can be merged with the table $T_i$ of a corresponding conversion unit $UC_i$ (20, 21, 22, and 23 in FIG. 1).

The pressures $P_i$ $(\alpha_j)$ and flow rates $Q_i$ $(\alpha_j)$ are characteristics of the equipment Ej and of the receiver $R_i$ which are associated with the control unit $J_i$. These values depend on the features specific to one piece of equipment $E_i$ or another, or to a series or to an identical type of equipment $E_i$, and on the functions $F_i$ to be executed.

The values $P_i$ $(\alpha_j)$ and $Q_i$ $(\alpha_j)$ correspond to the operating state of the equipment $E_i$ (8 . . . 11) when the control unit $J_i$ is put into the control position $(\alpha_j)$ by the operator.

The conversion unit $UC_i$ for conversion of the position $(\alpha_j)$ of the control unit $J_i$ provides a signal which is representative of the pressure required $P_i$ $(\alpha_j)$ and of the flow rate required $Q_i$ $(\alpha_j)$ and of the intensity $I_i$ $(\alpha_j)$ on the basis of the correspondence tables $T_i$ (FIG. 2, the correspondence tables $T_i$ are not shown in FIG. 1). These tables Ti are established according to the characteristics of the receivers $R_i$; they are derived from the experience and study of the movements of the receivers $R_i$. The tables Ti are not necessarily symmetrical towards the positive side or the negative side relative to a neutral position. These tables $T_i$ describe for example the flow rate and the pressure during rising and descent of the boom. Like the functions to be controlled, these tables Ti are not necessarily symmetrical towards the positive side or the negative side relative to the neutral position.

Certain control units $J_i$ can also have an amplitude of control which increases starting from the neutral position, and which returns to it without having a negative part.

The pressure $P_i$ $(\alpha_j)$ (pressure required) regulates the pressure in the receiver $R_i$, and the flow rate $Q_i$ $(\alpha_j)$ (flow rate required) controls the flow rate which supplies the receiver $R_i$. In the case of electrohydraulic distributors $D_i$, such as those used by way of preference according to the disclosure, the flow rate required $Q_i$ $(\alpha_j)$ and the intensity $I_i$ $(\alpha_j)$ of the control signal of the distributor $D_i$ are equivalent. The expression of flow rate $Q_i$ $(\alpha_j)$ is used for certain controls, and its translation into intensity $I_i$ $(\alpha_j)$ is used for the control of the distributor $D_i$, in order to obtain the flow rate $Q_i$ $(\alpha_j)$ which is required or attributed after correction in the case of flow rate sharing.

These two values required $P_i$ $(\alpha_j)$ and $Q_i$ $(\alpha_j)$ are processed in order to form the control signals $SP_{max}$, SQC applied to the pressure and flow rate regulator 6 of the pump 1; in the present description, this regulator 6 groups the two regulations together schematically.

The control installation 100 comprises:

- a processing module $MT_i$ (28, 29, 30, 31) associated with the control unit $J_i$, and generating the control signal $SCD_i$;
- general means which are common to the branches $BR_i$;
- an adder 24 which receives the flow rates required $Q_i$ $(\alpha_j)$ of the different control units $J_i$ in order to generate the cumulative flow rate signal SQC applied to the regulator 6; and
- a selector 25 which receives the pressures required $P_i$ $(\alpha_j)$ of the activated equipment $E_i$ in order to extract from it the maximal pressure $P_{max}$ and form the signal $SP_{max}$ destined for the regulator 6.

The processing module MT; generates the signal $SCD_i$ $(\alpha_j)$ on the basis of the intensity $I_i$ $(\alpha_j)$ representative of the flow rate required $Q_i$. Then, in flow sharing mode, the switch PTi multiplies the intensity $I_i$ ($\alpha_j$) a corrector coefficient $CR_i$ in order to obtain the final control signal $SCF_i$ that is supplied to the distributor Di for maneuvering the slider of the distributor $D_i$ towards its side ($\alpha_j$) or ($b_i$) and to supply one of the two chambers of the receiver $R_i$.

The corrector coefficient $CR_i$ depends on the following parameters:

- $Po_i$: reference pressure of the actuator 8, 9, 10, 11; this pressure is measured at the minimal speed of rotation No of the motor 2 for a control scale of the control unit $J_i$;
- No: minimal speed;
- $P_{max}$: maximal pressure possible for the course of the control unit $J_i$;
- N: normal controlled operating speed of the motor 2.

The minimal speed No and the pressure $PO_i$ are values which are recorded in the basic table $To_i$ associated with the branch $BR_i$; the table Toi can be merged with the table $T_i$ of the conversion unit $UC_i$.

The coefficient $CR_i$ is expressed by the following formula:

$$CR_i = \sqrt{\frac{N}{P_{max} \cdot No}} \cdot \sqrt{Poi} \tag{2}$$

The final control signal $SCF_i$ is thus expressed as follows:

$$SCF_i = CR_i \cdot I_i(\alpha_j)$$

The coefficient $CR_i$ is representative of the receiver $R_i$ in all of the receivers $R_i$ supplied in order to form the final control signal $SCF_i$ of the distributor $D_i$, as has just been explained. The intensity $I_i$ ($\alpha_j$) is that of the current necessary for control of the distributor $D_i$. This intensity Ii is applied to the distributor $D_i$ in order to control the flow rate $Q_i$ ($\alpha_j$) to be supplied to the distributor $D_i$ considered in isolation. The intensity Ii is corrected by the coefficient $CR_i$ ($\alpha_j$) in order to share the flow rate Q available supplied by the pump 1.

If the distributors $D_i$ are the same, the value of the intensity $I_i$ ($\alpha_j$) is the same for all the distributors $D_i$. However, if the distributors $D_i$ are different, the values of the intensity $I_i$ ($\alpha_j$) are different, and they are preferably contained in the table $T_i$ associated with each control unit $J_i$.

Figure 3:
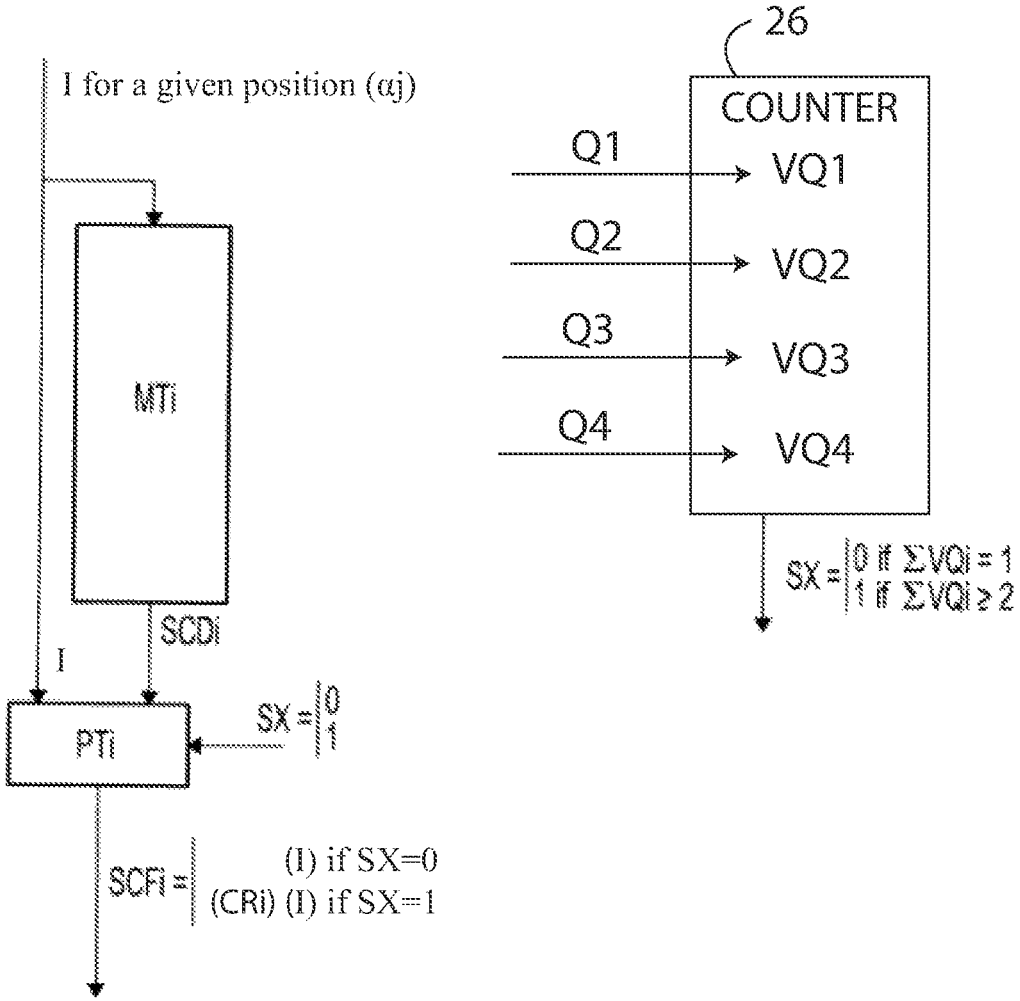
FIG. 3 is a shows a counter of the control installation and a final control signal output of a portion of a branch of the four branches of FIG. 1.

FIG. 2, which is completed by FIG. 3, shows the detail of the overall diagram of FIG. 1, limited to a branch $BR_i$ (i.e., the first branch BR1) of the transmission of the demand introduced by the movement or the position ($\alpha_j$) of the control unit $J_i$ for the distributor $D_i$ which supplies the receiver $R_i$ of the equipment $E_i$, as well as the common means of the installation 100 implemented in order to apply this demand to the control of the pump 1 and the distributor $D_i$.

The branch $BR_i$ is composed of the conversion unit $UC_i$ represented by its table $T_i$ generating the value $Q_i$ ($\alpha_j$) of the flow rate required and the pressure required $P_i$ ($\alpha_j$) and the intensity $I_i$ ($\alpha_j$) of the distributor $D_i$.

It comprises the processing module MT; which receives directly the intensity signal $I_i$ ($\alpha_j$) and other signals to be combined in order to obtain as output the control signal $SCD_i$ of the distributor $D_i$ of this branch $BR_i$.

The distributor with a slider $D_i$ is controlled in order to regulate (the positive or negative value of) the flow rate passing through the distributor $D_i$ in order to supply one or the other side (chamber) of the receiver $R_i$ in the form of a linear jack or rotary jack (hydraulic motor). The electrohydraulic distributor $D_i$ is controlled by an intensity $I_i$ which takes into account the position ($\alpha_j$) of the control unit $J_i$ corrected by the coefficient CR; if the installation 100 is in flow rate sharing mode.

The different components in material form or the form of program modules are connected to the general means of the installation 100, which are common to all the branches $BR_i$ of the installation 100.

Thus, the conversion unit $UC_i$ is connected to the pressure selector 25 which receives the pressure values $P_i$ (i=1–n) of all the activated branches $BR_i$ (i=1–n). The pressure selector 25 retains the maximal pressure value $VP_{max}$ of this set of values received, in order to apply the corresponding signal $SP_{max}$ to the processing module $MT_i$ and to the regulation unit 6 of the pump 1.

The conversion unit $UC_i$ is also connected to the processing module $MT_i$ and to an adder 24 in order to add the flow rate values $Q_i$ ($\alpha_j$).

The adder 24 receives the flow rates required $Q_i$ ($\alpha_j$) (i=1–n) of all the conversion units $UC_i$ of the activated branches BRi, in order to obtain the sum of the flow rates $Q_i$ ($\alpha_j$) and generate a control signal SQC applied to the regulator 6 of the pump 1.

The signals $P_i$ ($\alpha_j$) and $Q_i$ ($\alpha_j$) are representative of the operating state required by all the control units $J_i$ (i=1–n). This means that the control units $J_i$ in a neutral position of the branches $BR_i$ which are not activated at this moment (t) send a zero signal which does not intervene either in the selection of the pressure $P_{max}$ or in the sum of the flow rates Qi, such that the regulation unit 6 controls the pump 1 only according to the branches $BR_i$ which are active at that instant (t).

The corrector coefficient $CR_i$ is obtained from the values $P_i$ ($\alpha_j$) and $Q_i$ ($\alpha_j$) of each branch $BR_i$ activated, by determining in advance the parameters of each branch $BR_i$ taken separately, then using the pressure $P_i$ ($\alpha_j$) and flow rate $Q_i$ ($\alpha_j$) values associated with the regulation position (j) of the control units $J_i$ of the activated branches BRi; the activated branches BRi are those which are connected to the hydraulic circuit of the pump 1 at an instant (t) during the operating phase of the installation 100, in order to control the common means of the installation 100, the pump 1 and its motor 2, by means of the control regulator 6 and the means specific to each branch $BR_i$ activated, in order to distribute the flow rate Q available at the pressure $P_{max}$ most appropriate for the demand of the control units $J_i$. The demand of the branches $BR_i$ is the pressure required $P_i$ ($\alpha_j$) and the flow rate $Q_i$ ($\alpha_j$). The controlled means of each branch are the distributors $D_i$.

1) Determination of the Parameters of a Branch $BR_i$:

These parameters depend on the tables $T_i$ giving the flow rate $Q_i$ and the pressure $P_i$ of each receiver $R_i$ as well as the intensity $I_i$ ($\alpha_j$) of control of the distributor $D_i$ taken alone, according to the control position ($\alpha_j$) of the control unit $J_i$ associated with each control position ($\alpha_j$) for the control range of the control unit $J_i$ of this receiver $R_i$.

$$T_i(\alpha_j) \leftrightarrow P_i(\alpha_j), Q_i(\alpha_j), I_i(\alpha_j)$$

The table $T_i$ contains the values $P_i$ ($\alpha_j$), $Q_i$ ($\alpha_j$), $I_i$ ($\alpha_j$) obtained by measurement of the real values, carried out during use of the equipment $E_i$ alone in real conditions, by maneuvering the control unit $J_i$ and controlling the pump 1 of the hydraulic circuit and the distributor $D_i$.

The table $T_i$ is the summary of the measurements carried out according to displacement increments of the control unit $J_i$ associating with each position ($\alpha_j$) a pressure $P_i$ ($\alpha_j$) and a flow rate $Q_i$ (a) (or the intensity $I_i$ ($\alpha_j$) which is representative of the flow rate) specific to the branch $BR_i$ and the degree of opening of the distributor $D_i$ according to the control signal (intensity) which is applied to it.

In a following preparatory step, there is determination of the pressure $Po_i$ of the receiver $R_i$ for the minimum speed of rotation No of the motor 2 driving the pump 1.

During the ordinary operation of the equipment $E_i$ the pressure $P_i$ and the speed of rotation N of the motor 2 driving the pump 1 are measured. The piece of equipment $E_i$ is the only one activated for these measurements of the variation of pressure $P_i$ according to the speed of rotation N of the motor 2.

2) Corrector Coefficient $CR_i$:

In order to distribute the flow rate Q supplied by the pump 1, it is necessary to attribute to each flow rate $Q_i$ ($\alpha_j$) required by the equipment $E_i$ activated at that moment (t) a corrector coefficient $CR_i$ in order to share the flow rate, and allow all the equipment $E_i$ to operate, even if the operating mode at this moment is more or less reduced as a result of the distribution of the flow rate Q supplied by the pump 1.

According to the disclosure, the corrector coefficient $CR_i$ for each branch $BR_i$ (i=1 . . . n) is as follows:

$$CR_i = \sqrt{\frac{Poi \cdot N}{P_{max} \cdot No}} \tag{1}$$

This formula is also written as:

$$CR_i = \sqrt{\frac{N}{P_{max} \cdot No}} \cdot \sqrt{Poi} \tag{2}$$

In this formula:

$Po_i$=pressure in the receiver $R_i$ at the minimum speed No;

No=minimum speed of rotation of the motor 2;

$P_{max}$=maximum pressure of all of the operating pressures required by the equipment $E_i$ ($R_i$) activated at an instant (t);

N=speed of rotation of the motor 2 of the pump 1 at the instant (t).

The terms $Po_i$ and No are fixed values, specific to each piece of equipment $E_i$ recorded in the table $T_i$ associated with the branch $BR_i$.

The pressure $P_{max}$ is the highest pressure of the pressures $P_i$ required by the equipment $E_i$ activated at the instant t.

N is the speed of rotation of the motor at the instant (t).

Thus, the corrector coefficient $CR_i$ makes the following intervene:

terms common to all of the pieces of equipment $E_i$ activated at the instant t in the hydraulic circuit: N, No, $P_{max}$;

a term specific to each piece of equipment Ei: $Po_i$;

the coefficient $CR_i$ of the branch BR; thus depends solely on the term $Po_i$ which is specific to the branch $BR_i$:

$$CR_i=f(Po_i)$$

Since the corrector coefficient $CR_i$ is associated with the flow rate required $Q_i$, by analogy with the Torricelli-Bernouilli formula, the following equation is obtained:

$$Q^2=kP \text{ or } Q=k\sqrt{P};$$

the flow rate Q being equivalent to a speed of flow, and the real flow rate $Q_i$réel supplied to the equipment $E_i$ will depend on the flow rate required:

$$Q_i(\alpha_j)=CR_i \cdot Q_i(\alpha_j)=f(Po_i) \cdot Q_i(\alpha_j)$$

The value of $P_{max}$ is not a constant according to time, but can be modified during an operating phase of the hydraulic installation 100, since the pieces of equipment $E_i$ activated can change; one piece of equipment $E_i$ stops and/or another one joins the hydraulic circuit; the activation of the equipment $E_i$ can modify the pressure $P_{max}$ if this piece of equipment $E_i$ has the highest value $P_i$ from amongst the pressures $P_i$ required by the equipment $E_i$ activated at this instant.

The coefficients $CR_i$ are specific to all the pieces of equipment $E_i$ including the one corresponding to the pressure $P_i$=$P_{max}$.

3) Determination of the Final Control Signal $SCF_j$:

The final control signal $SCF_i$ for control of the distributor $D_i$ of the branch $BR_i$ in flow rate sharing mode controls the supply of the receiver $R_i$ according to:

parameters of the receiver $R_i$ of the equipment $E_i$;

the position ($\alpha_j$) of the control unit $J_i$;

other branches $Br_j$ activated at the same time, i.e. the pressure $P_j$ and the flow rate Qj of the other branches BRj.

The flow rate $Q_i$ and the pressure $P_i$ required by all the receivers $R_i$ activated are values used to distribute the flow rate Q supplied by the pump P at a pressure $P_{max}$ selected according to the control method which is the subject of the disclosure.

FIG. 1 shows the diagram of a control installation 100 with the references of the more detailed figure (FIG. 2) in which i=1, 2, 3, 4.

4) Determination of the Operating Mode (FIG. 3)

The flow rate sharing operating mode is a downgraded mode which allows all the receivers $R_i$ activated to operate without this operation then making it possible to obtain the maximal performance levels of each piece of equipment $E_i$.

The flow rate sharing mode does not have as its limit the operating mode for controlling a single receiver $R_i$ activated from amongst all of the receivers concerned.

For this reason, it is necessary to switch the installation 100 between the two modes by means of the switches $PT_i$ associated with each branch $BR_i$, but taking into account the interaction which the operation of a single branch $BR_i$ presupposes, and which thus does not need flow rate sharing.

The operating mode signal SX is supplied by the counter 26 which receives the flow rates required $Q_i$ ($\alpha_j$) of all the control units $J_i$. These flow rates $Q_i$ ($\alpha_j$) are transformed into flow rate values $VQ_i$ ($\alpha_j$) which are binary logic values:

$$VQ_i(\alpha_j)=0 \text{ if } Q_i(\alpha_j)=0$$

$$VQ_i(\alpha_j)=1 \text{ if } Q_i(\alpha_j)\neq 0$$

The counter 26 counts all the values $VQ_i$ ($\alpha_j$) received, and supplies the mode signal of SX defined as follows:

$$SX=|0 \text{ if the total } \Sigma Q_i(\alpha_j)=1|1 \text{ if the total } \Sigma Q_i(\alpha_j)\geq 2$$

In other words:

$SX$=0 represents the operation without flow rate sharing $SX$=1 represents the operation with flow rate sharing.

The signal SX is applied to all of the switches $PT_i$, irrespective of the operating state required, or the present state of the branches $BR_i$.

The switches $PT_i$ switch in the identical mode determined by the signal SX, which they all receive.

If the mode required is that of flow rate sharing, this takes place naturally between the only receivers Ri activated.

If the mode required is the direct mode, without flow rate sharing (i.e., SX=0), all the switches $PT_i$ allow the final control signal $SCF_i$=I (aj) to pass.

However, when a single branch $BR_i$ is activated, it is the only branch BRi which receives the flow rate Qi at the pressure defined. The corrector coefficient CRi is thus to some extent equal to 1, whereas in flow rate sharing mode the coefficient $CR_i$ is always less than 1.

LIST OF THE MAIN ELEMENTS

100 Control installation
1 Pump
2 Motor
5 Sensor for the speed of rotation of the pump
6 Control regulator of the pump
8 Boom actuator
9 Arm actuator
10 Bucket actuator
11 Turret hydraulic motor
12 Distributor of the boom
13 Distributor of the arm
14 Distributor of the bucket
15 Distributor of the hydraulic motor
16 Control lever of the boom
17 Control lever of the arm
18 Control lever of the bucket
19 Control lever of the turret
20-23 Conversion unit
24 Adder
25 Selection unit
26 Counter
No Minimum speed of rotation
N Speed of rotation
$UC_i$ Conversion unit
$MT_i$ Processing module
$PT_i$ Switch
$SCD_i$ ($\alpha_j$) Control signal of the distributor
$SCF_i$ Final control signal
SX Operating mode signal
$D_i$ Distributor
$I_i$, $I_i$ ($\alpha_j$) Basic control intensity of the distributor $D_i$
$E_i$ Equipment controlled
$F_i$ Function of the equipment
$A_j$ Position of the control unit $J_i$
$J_i$ Control unit
$BR_i$ Branch of the equipment $E_i$
$T_i$ Table of correspondence between the position ($\alpha_i$) of the control unit $J_i$ and the pressure $P_i$ and the flow rate $Q_i$ of hydraulic liquid supplying the receiver $R_i$ of the equipment $E_i$
$CR_i$ Flow rate corrector coefficient $Q_i$
$P_i$ ($\alpha_j$), $P_i$ Pressure required by the receiver $R_i$
$Q_i$ ($\alpha_j$), $Q_i$ Flow rate required by the receiver $R_i$
VQI ($\alpha_j$) Flow rate value
$Po_i$ Pressure in the equipment $E_i$ for the speed of rotation No
$T_i$ Table of correspondence of the branch $BR_i$
$To_i$ Table of basic values of the branch $BR_i$

What is claimed is:

1. A control system for controlling a hydraulic installation with a plurality of hydraulic actuators operating in parallel, comprising:

a pump configured to pump hydraulic liquid;

a pressure and flow regulator configured to regulate a pressure and a flowrate of the hydraulic liquid pumped by the pump;

a plurality of conversion units, each of the plurality of conversion units configured to generate a respective pressure value and a respective flow rate value corresponding to respective control positions of corresponding control units for each of the hydraulic actuators;

a plurality of distributors, each of the plurality of distributors associated with a respective hydraulic actuator of the plurality of hydraulic actuators and configured to supply the respective hydraulic actuator with the hydraulic fluid according to the respective pressure value and the respective flow rate value;

a plurality of operating mode switches, each of the plurality of operating mode switches associated with a respective distributor of the plurality of distributors and configured to switch the respective distributor to a flow rate sharing mode and a mode without flow rate sharing; and a flow rate value counter configured to provide an operating mode control signal to the plurality of operating mode switches to switch the plurality of distributors to the flow rate sharing mode when at least two of the hydraulic actuators of the plurality of hydraulic actuators are activated, and to the mode without flow rate sharing when only one of the hydraulic actuators of the plurality of hydraulic actuators is activated;

an adder configured to receive and to sum the generated respective flow rate values from each of the conversion units and to generate a flow rate regulation signal corresponding to the sum of all of the generated respective flow rate values; and a selector configured to receive the pressure values from each of the conversion units and to generate a maximal pressure signal corresponding to a highest received pressure value, wherein the pump is controlled in the flow rate sharing mode by the flow rate regulation signal and by the maximal pressure signal.

2. The control system according to claim 1, wherein:

the flow rate value counter is configured (i) to receive the generated respective flow rate values from each of the conversion units, (ii) to convert received generated respective flow rates with a flow rate of zero to a binary 0 value, (iii) to convert received generated respective flow rates with a non-zero flow rate to a binary 1 value, and (iv) to sum the binary values, the flow rate value counter is configured to generate the operating mode control signal, the operating mode control signal has a 0 value when the summed binary value is equal to one, the operating mode control signal has a 1 value when the summed binary value is greater than or equal to two, the operating mode control signal is provided to each operating mode switch of the plurality of operating mode switches, the plurality of operating mode switches configure the respective distributors in the flow sharing mode when the operating mode control signal has the 1 value, and the plurality of operating mode switches configure the respective distributor in the mode without flow sharing when the operating mode control signal has the 0 value.

3. The control system according to claim 1, wherein:

a respective control position of each of the plurality of control units is one control position of a plurality of control positions;

each respective control unit of the plurality of control units is associated with a respective conversion unit of the plurality of conversion units, each conversion unit contains a respective table of the pressure values and the flow rate values associated with each of the plurality of control positions of the respective control unit; and the pressure and flow rate values in the respective table are based on a pressure and flow rate for each of the plurality of control positions when the respective operating mode switch is in the mode without flow rate sharing during use of the hydraulic installation.

4. The control system according to claim 1, wherein:

in the flow rate sharing mode, the respective flow rate value of each of the plurality of control units is multiplied by a respective corrector coefficient to form a respective control signal of the respective distributor of the plurality of distributors.

5. The control system according to claim 4, wherein:

the distributors of the plurality of distributors are electro-hydraulic distributors controlled by a respective control intensity, the control intensity corresponds to a flow rate required by the respective distributor considered alone without flow rate sharing, and the respective control intensity alone controls a cross-section of a passage between a total closure and opening according to the respective control position.

6. The control system according to claim 5, wherein the respective corrector coefficient ($CR_i$) depends on common parameters of the hydraulic installation according to the formula:

wherein:

$$CR_i = \sqrt{\frac{N}{P_{max} \cdot No}} \cdot \sqrt{Poi} \tag{2}$$

$Po_i$=pressure in the respective hydraulic actuator at a minimum speed of rotation of a motor of the pump;

No=a minimum speed of rotation of the motor of the pump;

$P_{max}$=maximum pressure of all of the pressure values from each of the conversion units;

N=speed of rotation of the motor of the pump at an instant (t); and the minimum speed of rotation of the motor is the lowest operational speed of the motor of the pump.

7. A control system for controlling a hydraulic installation with a plurality of hydraulic actuators operating in parallel, comprising:

a pump configured to pump hydraulic liquid;

a plurality of conversion units, each conversion unit configured to generate respective pressure values and respective flow rate values corresponding to respective control positions of corresponding control units for each of the hydraulic actuators;

a plurality of distributors, each distributor associated with a respective hydraulic actuator of the plurality of hydraulic actuators and configured to supply the respective hydraulic actuator with the hydraulic fluid according to the respective pressure values and the respective flow rate values;

a plurality of operating mode switches, each of the plurality of operating mode switches associated with a respective distributor of the plurality of distributors and configured to switch the respective distributor to a flow rate sharing mode and a mode without flow rate sharing; and a flow rate value counter configured to provide an operating mode control signal to the plurality of operating mode switches to switch the plurality of distributors to the flow rate sharing mode when at least two of the hydraulic actuators of the plurality of hydraulic actuators are activated, and to the mode without flow rate sharing when only one of the hydraulic actuators of the plurality of hydraulic actuators is activated;

an adder configured to receive and to sum the respective flow rate values from each of the conversion units and to generate a flow rate regulation signal corresponding to the sum of all of the respective flow rate values; and a selector configured to receive the pressure values from each of the conversion units and to generate a maximal pressure signal corresponding to a highest received pressure value, wherein the pump is controlled in the flow rate sharing mode based on (i) the flow rate regulation signal, and (ii) the maximal pressure signal.

* * * * *